US008476546B2

(12) United States Patent
Abroy

(10) Patent No.: US 8,476,546 B2
(45) Date of Patent: Jul. 2, 2013

(54) DUAL BREAKING POINT ELECTRICAL JOINT

(75) Inventor: Hamid S. Abroy, Lexington, KY (US)

(73) Assignee: Schneider Electric USA, Inc., Palatine, IL (US)

( * ) Notice: Subject to any disclaimer, the term of this patent is extended or adjusted under 35 U.S.C. 154(b) by 357 days.

(21) Appl. No.: 12/900,965

(22) Filed: Oct. 8, 2010

(65) Prior Publication Data

US 2012/0085736 A1 Apr. 12, 2012

(51) Int. Cl.
*H01H 3/00* (2006.01)

(52) U.S. Cl.
USPC ..... 218/149; 200/15; 200/17 R; 200/18

(58) Field of Classification Search
USPC ..... 200/15, 17 R, 18, 252–261; 218/22–40, 218/149–158
See application file for complete search history.

(56) References Cited

U.S. PATENT DOCUMENTS

| | | | | |
|---|---|---|---|---|
| 2,224,380 | A | | 12/1940 | Crabbs et al. |
| 2,571,864 | A | | 10/1951 | Graybill |
| 3,240,888 | A | | 3/1966 | Rys et al. |
| 3,335,399 | A | | 8/1967 | Rys |
| 3,339,047 | A | | 8/1967 | Rys et al. |
| 3,346,711 | A | | 10/1967 | Rys et al. |
| 4,302,643 | A | | 11/1981 | Cox et al. |
| 5,057,654 | A | * | 10/1991 | Meyer et al. ..... 218/16 |
| 5,322,982 | A | * | 6/1994 | Leger et al. ..... 200/401 |
| 5,609,245 | A | | 3/1997 | Cassity et al. |
| 5,737,195 | A | | 4/1998 | Cassity et al. |
| 5,739,488 | A | | 4/1998 | Cassity et al. |
| 5,746,306 | A | | 5/1998 | Cassity et al. |
| 5,777,283 | A | | 7/1998 | Greer |
| 6,313,416 | B1 | | 11/2001 | Abroy et al. |
| 6,331,684 | B1 | | 12/2001 | Abroy et al. |

FOREIGN PATENT DOCUMENTS

| | | |
|---|---|---|
| DE | 197 34 676 A1 | 2/1999 |
| EP | 0 062 369 A2 | 10/1982 |

OTHER PUBLICATIONS

Schneider Electric; Solar Disconnect Switches; Heavy Duty Safety Switches (Fusible and Non-Fusible) on direct Current and Photovoltaic Systems; downloaded Sep. 9, 2010; (1 page).
International Search Report corresponding to co-pending International Patent Application Serial No. PCT/US2011/054543, European Patent Office, dated Jan. 17, 2012; (4 pages).
International Written Opinion corresponding to co-pending International Patent Application Serial No. PCT/US2011/054543, European Patent Office, dated Jan. 17, 2012; (5 pages).

* cited by examiner

*Primary Examiner* — Tulsidas C Patel
*Assistant Examiner* — Marina Fishman
(74) *Attorney, Agent, or Firm* — Nixon Peabody LLP

(57) ABSTRACT

Switch assemblies and electrical distribution devices for making and breaking electrical connections in an electrical circuit are disclosed herein. One aspect of the present disclosure is directed to a switch assembly that includes a pair of electrically conductive jaws attached to a platform. The first jaw is configured to electrically connect to an incoming line of the electrical circuit, whereas the second jaw is configured to electrically connect to an outgoing line. The switch assembly also includes a blade having at least two electrically conductive plates that are attached to and spaced from each other via an electrical insulator. The blade is pivotably coupled to the platform to rotate between a disengaged position, whereat the blade is electrically decoupled from the first and second jaws, and an engaged position, whereat the blade delivers an electrical current from the incoming line through the first and second plates to the outgoing line.

19 Claims, 5 Drawing Sheets

DUAL BREAKING POINT ELECTRICAL JOINT

FIELD OF THE INVENTION

The present invention relates generally to electrical switches, and more particularly to blade- or knife-type electrical safety switches.

BACKGROUND

In electronics, a switch is an electrical component that can break an electrical circuit, for example, to interrupt the current flow or divert the current from one electrical path to another. In blade- or knife-type electrical safety switches, the circuit for each phase is completed through a pivotable, electrically conductive knife or blade, which engages a corresponding contact to electrically connect the line current to the load. In some applications, the blade-type switches are mounted in an enclosure and incorporate an insulating base to carry an incoming line terminal for each phase. One such blade-type electrical switch is disclosed, for example, in U.S. Pat. No. 6,331,684, to Hamid S. Abroy et al., which is incorporated herein by reference in its entirety.

Switches can be of the fusible type or the non-fusible type. In non-fusible switches, the blade engages a contact which is directly electrically connected to the load. In fusible switches, in contrast, the blade engages a contact which is electrically connected to a fuse clip having a fuse seated thereon. The fuse is then electrically connected to the load. U.S. Pat. No. 4,302,643, to Russell Cox et al., and U.S. Pat. No. 5,777,283, to David E. Greer, both of which are incorporated herein by reference in their respective entireties, disclose fusible switch assemblies utilizing the abovementioned construction. Fusible switches are often used in switchboards to distribute power for industrial, commercial, and manufacturing applications.

In some currently designed safety switches, the voltage breaking point of the blades from the jaws takes place at one location, and the generated arc is guided through the arc housing, safely managed, and disposed. In many applications, more power must be distributed through enclosures which are the same size or smaller. For instance, as solar energy becomes more desirable, a higher voltage per pole on the safety switch will be required. This requires increasing the electrical rating of the switch to carry a higher voltage and current density while decreasing the size of the enclosure housing the electrical parts.

When the wattage across a switch is sufficiently large (e.g., 600 Vac per pole and 600 Vdc through two pole (300 Vdc/Pole)), the electron flow across switch contacts can be sufficient to ionize the air molecules between the contacts as the switch is opened or closed, forming an electric arc. The electric arc is very hot, so much so that it can erode the metal surfaces of the switch contacts. Accordingly, there is a need for a switch assembly and switching mechanism that can effectively and efficiently quench arcs generated in high voltage applications, while maintaining a sufficiently small overall footprint. The switch assembly should be economical to manufacture, and be capable of being assembled easier and faster to reduce costs. In addition, field assembly and retrofit should be simplified, and the switch should have widespread application. Another need would be to bring multiple voltage outputs into a multi-pole safety switch and be able to disconnect the power sources with a minimum number of safety switches.

SUMMARY

According to some aspects of the present disclosure, the voltage across the safety switch is broken down in two different places and each arc is managed separately, therefore allowing the switch to have a higher voltage per pole. By dividing the arc voltage in half, it can be managed more efficiently and each pole of the switch can be used separately as opposed to using two poles in series. In some embodiments, the foregoing objectives can be achieved while keeping the safety switch in the same approximate dimensions and envelope as existing safety switch assemblies. Moreover, the safety switch assembly of some embodiments meets visible blade requirements and, in some embodiments, can break 600 Vdc or more per pole while meeting the current overload requirements prescribed by standard agencies, such as the Underwriters Laboratory (UL) 98 Standard.

Each safety switch can use two blades in conjunction with an intermediate insulator. The tripartite blade-insulator-blade assembly can be laminated and adapted to pivot about a hinge. A separate jaw can be provided for making contact with each electrically conductive side of the tripartite blade such that the arc voltage is broken at two places and in half.

In accordance with some aspects of the present disclosure, a switch assembly is presented for making and breaking electrical connections in an electrical circuit. The switch assembly includes a platform with first and second electrically conductive jaws operatively attached to the platform. The first jaw is configured to electrically connect to an incoming line of the electrical circuit, whereas the second jaw is configured to electrically connect to an outgoing line of the electrical circuit. The switch assembly also includes a blade with a first electrically conductive plate attached to and spaced from a second electrically conductive plate via an electrical insulator. The blade is pivotably coupled to the platform to rotate between a disengaged position, whereat the blade is electrically decoupled from the first and second jaws, and an engaged position, whereat the blade delivers an electrical current received from the first jaw through the first and second plates to the second jaw.

In other aspects of the present disclosure, a switch assembly is featured for making and breaking electrical connections in an electrical circuit. The switch assembly includes an electrically insulated platform with first and second electrically conductive jaws mounted thereto. The first jaw is configured to electrically connect to an incoming line of the electrical circuit, whereas the second jaw is configured to electrically connect to the outgoing line. The switch assembly also includes a blade with a first electrically conductive plate attached to and electrically insulated from a second electrically conductive plate via an electrical insulator. The blade is pivotably coupled to the platform to rotate between an engaged position, whereat the blade delivers an electrical current received from the incoming line via the first jaw through the first and second plates to the outgoing line via the second jaw, and a disengaged position, whereat the blade is electrically decoupled from the first and second jaws such that the voltage of the electrical load is broken down separately at the first jaw and at the second jaw.

According to other aspects of the present concepts, an electrical distribution device is presented for connecting to an electrical circuit with incoming and outgoing lines. The electrical distribution device includes an enclosure with an electrically insulated platform disposed within the enclosure. A first electrically conductive jaw is mounted to the platform adjacent a second electrically conductive jaw. The first jaw is configured to electrically connect to an incoming line of the electrical circuit, whereas the second jaw is configured to electrically connect to an outgoing line. The second jaw is distinct and spaced from the first jaw. The electrical distribution device also includes one or more blades, each having a first electrically conductive plate attached to and electrically insulated from a second electrically conductive plate via an electrical insulator. An electrically conductive, single-piece mounting hinge pivotably couples the blade to the platform. A rotor is rotatably mounted within the enclosure. The rotor has at least one blade slot receiving the blade therethrough. The rotor is configured to selectively move the blade between a disengaged position, whereat the blade is electrically decoupled from the first and second jaws, and an engaged position, whereat the blade distributes an electrical current received from the incoming line via the first jaw through the first and second plates to the outgoing line via the second jaw.

The above summary is not intended to represent each embodiment or every aspect of the present disclosure. Rather, the foregoing summary merely provides an exemplification of some of the novel features included herein. The above features and advantages, and other features and advantages of the present disclosure, will be readily apparent from the following detailed description of the embodiments and best modes for carrying out the present invention when taken in connection with the accompanying drawings and appended claims.

Figure 1:
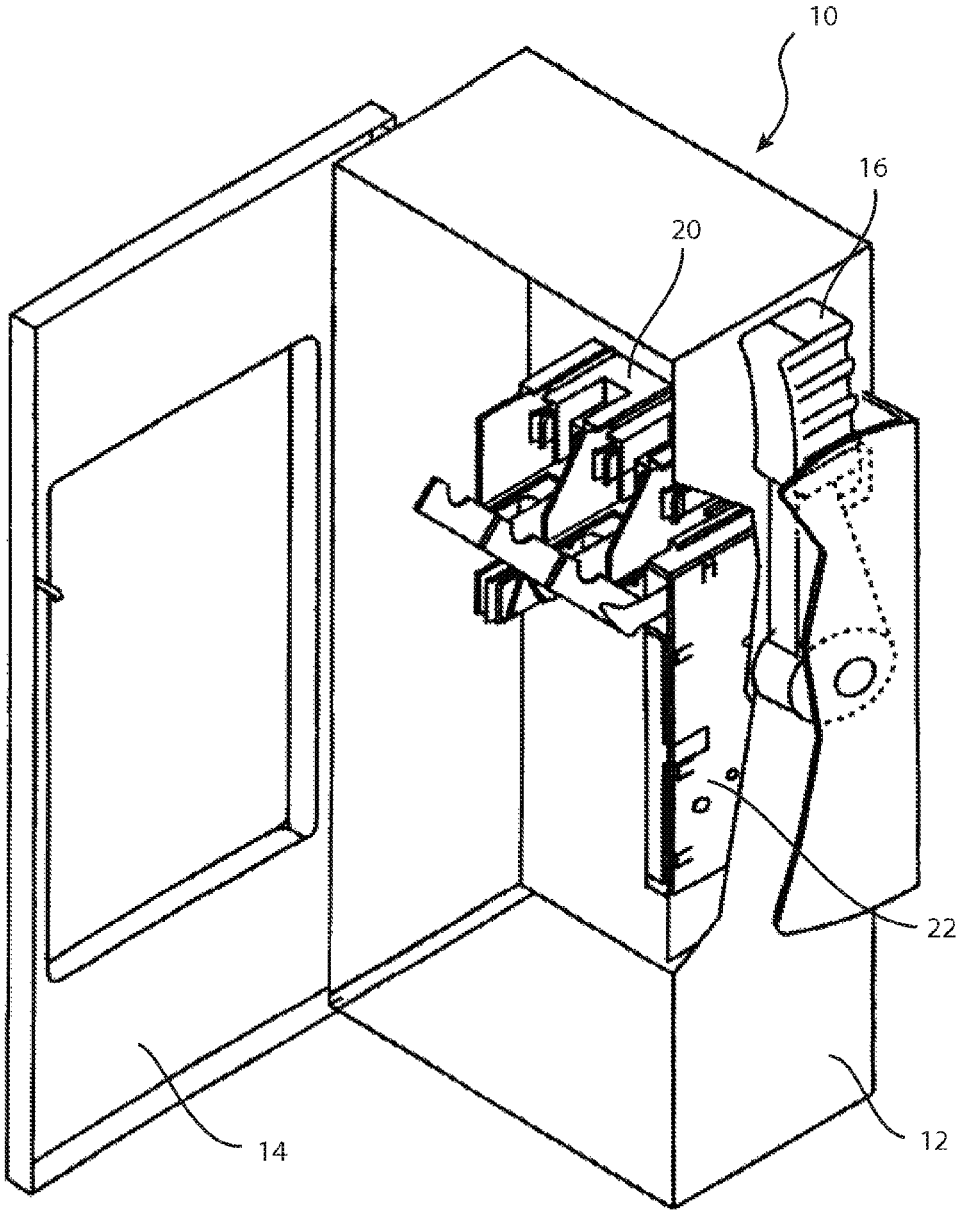
FIG. 1 is a perspective view illustration of an electrical distribution device in accordance with embodiments of the present disclosure.

While the present disclosure is susceptible to various modifications and alternative forms, specific embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION

Referring now to the drawings, wherein like reference numerals refer to like components throughout the several views, FIG. 1 illustrates an exemplary electrical distribution device 10 for a multi-phase circuit. The electrical distribution device 10 includes an enclosure or housing 12 having a door 14 that is pivotably mounted to the front of the enclosure 12 to transition between an open position (shown in FIG. 1), thereby providing access to the interior of the enclosure 12, and a closed position (not shown), thereby restricting access to the interior of the enclosure 12. A handle 16 is rotatably mounted to the enclosure 12 on the exterior of a side wall thereof. The interior of the enclosure 12 houses, among other things, a switch assembly 20 and a switching mechanism 22. In a multi-phase circuit, there is an electrical power line to service each respective phase entering the enclosure 12. The switch assembly 20 described herein is capable of being utilized, for example, for a two-, three-, four- or six-phase circuit. In accordance with the teachings herein, one would be readily able to change the number of phases by modifying the necessary components accordingly.

In the embodiment illustrated in FIG. 2, the switch assembly 20 is modular and, in some configurations, is adapted to be modified into a fusible switch and a non-fusible switch, as described below. In either configuration, the switch assembly 20 generally includes one or more insulating bases 28, one or more blades 30 each with a complementary blade hinge 32 (best seen in FIG. 4), a rotor 34, multiple line terminals or "lugs" 36A and 36B, multiple contact members or "jaws" 38A and 38B (best seen in FIG. 4), an insulated rotor-mounting base 40, and one or more arc suppressing housings 42 each of which supports an array of arc suppressing plates, collectively designated as 44 in FIG. 2.

The electrically insulating base 28 of the switch assembly 20, commonly referred to as a line base or platform, generally operates to provide a module for a single phase of a multi-phase circuit. The insulating base 28 can be integrally formed (e.g., via injection molding) of an electrically insulating material, such as a thermoplastic polymer, an example of which is sold by the General Electric Company under the tradename VALOX®. In a multi-phase application, multiple interlocking insulating bases 28 are mounted adjacent one another inside the electrical distribution device 10, each base 28 being connected to a respective line service for a phase. In the illustrated embodiment, the insulating base 28 has a generally square-polyhedron shape with a bottom surface 25 integral with (i.e., manufactured as a single element) opposing sidewalls 27 and 29, each of which extends generally perpendicularly from a respective lateral edge of the insulating base 28. The opposing sidewalls 27, 29 provide the components in the base 28 separation and arc protection from the other phases in adjacent insulating bases. A U-shaped stand 31 is integral with and extends generally perpendicularly from a forward edge of the insulating base 28. The U-shaped stand 31 is configured to mate with and align the arc suppressing housings 42 with respect to the insulating base 28.

In a multi-phase application with a plurality of interlocking insulating bases 28, at least one of the insulating bases 28 is secured to the enclosure 12. For example, threaded fasteners (e.g., screws) or other mounting hardware can be inserted through apertures in the insulating bases 28 to secure the base 28 to the enclosure 12. Then, after at least one of the bases 28 is secured to the enclosure 12, the remainder of the insulating bases 28 can be secured to and operatively supported by a respective adjacent base 28. In the illustrated embodiment, however, each of the insulating bases 28 is not only connected to another base, but is also secured to the enclosure 12.

Figure 2:
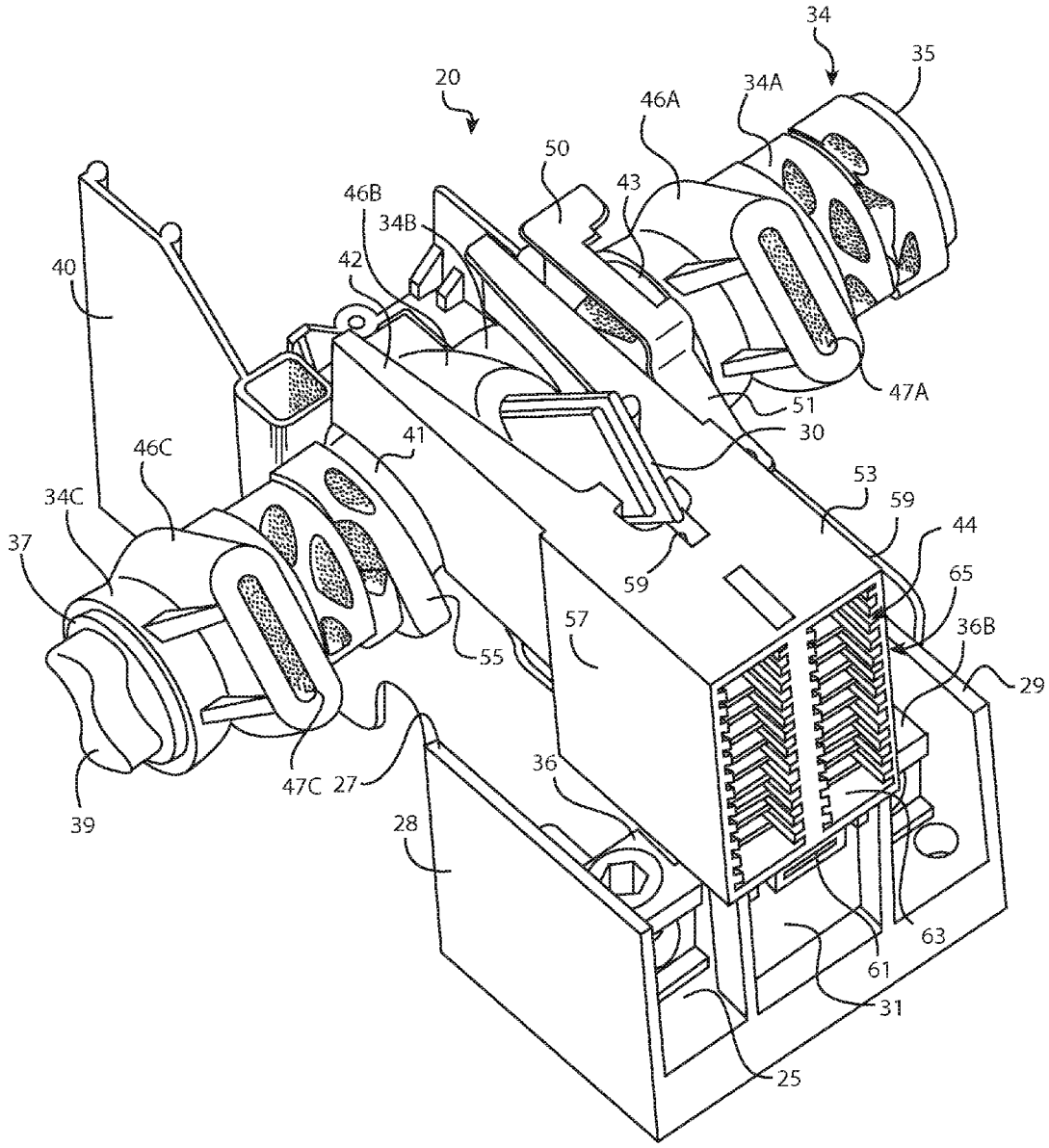
FIG. 2 is an isometric illustration of an exemplary electrical switch assembly with a dual breaking electrical joint in accordance with embodiments of the present disclosure.
Figure 3:
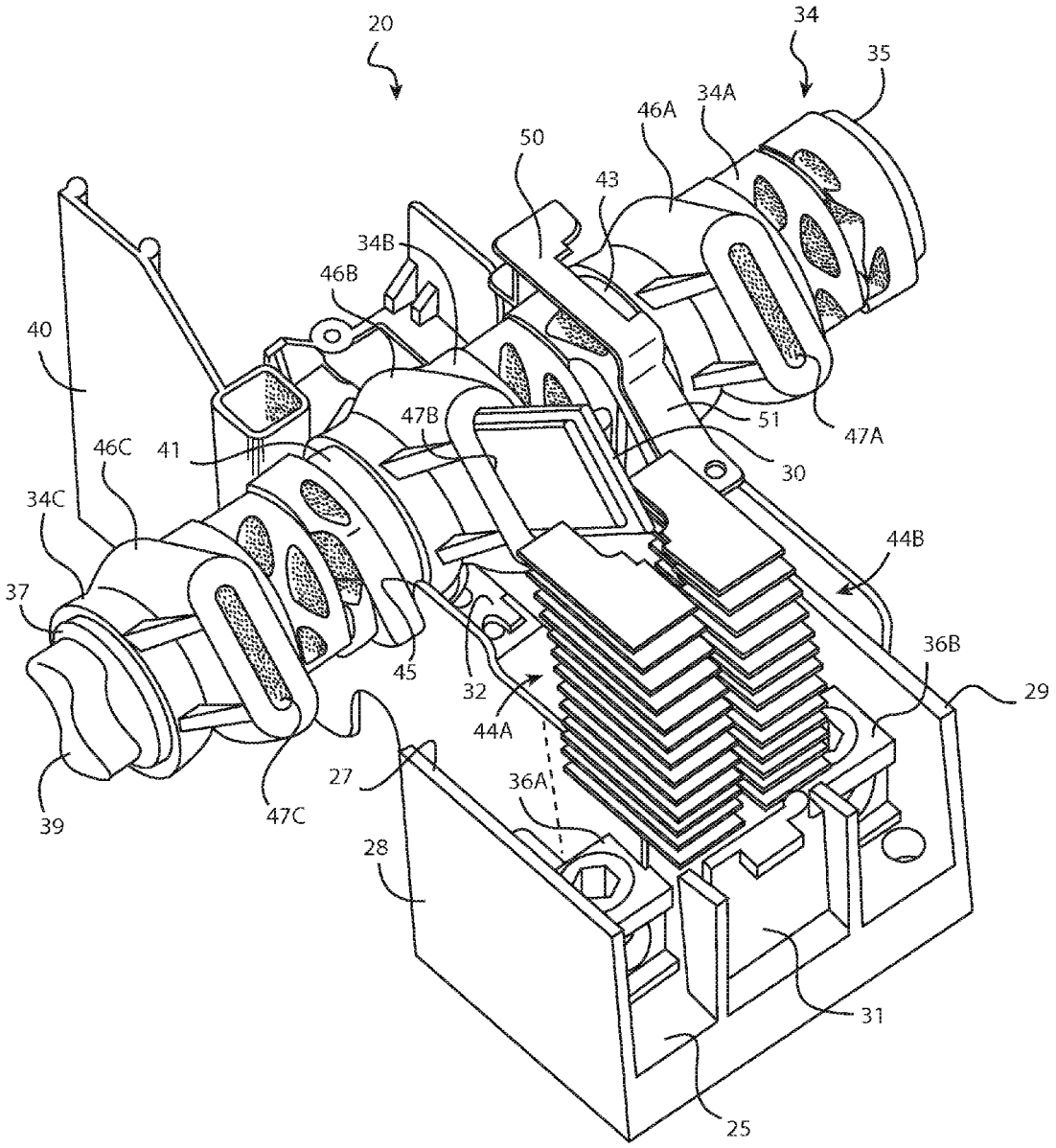
FIG. 3 is an isometric illustration of the exemplary electrical switch assembly of FIG. 2 shown without the arc suppressing housing.

With reference to both FIGS. 2 and 3, the rotor 34 is designed to move the blade 30 about a pivot position. It is generally desirable that the rotor 34 be made from an electrically insulating material, such as CYGLAS™ 620M thermoset polyester, which is available from Cytec Industries Inc. The rotor 34 of FIGS. 2 and 3 is comprised of three segments: a first rotor segment 34A, a second rotor segment 34B and a third rotor segment 34C. It should be recognized, however, that the number of segments in the rotor 34 can be varied from the number illustrated herein without departing from the scope and spirit of the present disclosure. Each segment 34A, 34B, 34C has a generally cylindrical shape with opposing first and second ends 35 and 37, respectively. The second end 37 of each rotor segment 34A, 34B, 34C has an integral geometric protrusion or boss 39 extending longitudinally therefrom. The first end 35 of each rotor segment 34A, 34B, 34C has an indentation or pocket (not visible in the views provided). The protrusion 39 of FIGS. 2 and 3 has a "dog bone" like shape and extends, for example, approximately 0.375 in. outwardly from the end 35 of the rotor 34. The indentation, on the other hand, which has a complementary "dog bone" like shape, is sunken inwards with a depth, for example, of approximately 0.400 in. In general, the indentation in the first end 35 of each rotor segment 34A, 34B, 34C is sized and shaped to receive therein the protrusion 39 of an adjacent rotor segment 34A, 34B, 34C.

The rotor 34 of FIGS. 2 and 3 is shown with first and second longitudinally spaced hub sections 41 and 43. Each hub section 41, 43 is adapted (i.e., shaped and sized) to rotate on a respective upper race 45 of the insulated rotor-mounting base 40. Each hub section 41, 43 is partially formed from a narrower portion of the rotor 34 that is defined between each rotor segment 34A, 34B, 34C. As such, when the adjacent rotor segments 34A, 34B, 34C are connected at their respective ends, as described in the preceding paragraph, a hub section 41, 43 is created.

Each segment 34A, 34B, 34C of the rotor 34 has an integral sleeve 46A, 46B and 46C, respectively. The integral sleeves 46A, 46B, 46C have respective slots 47A, 47B and 47C that extend therethrough, transverse to the longitudinal axis of the rotor 34. Each slot 47A, 47B, 47C is adapted (i.e., shaped and sized) to receive therethrough and engage a corresponding blade 30, as seen in FIGS. 2 and 3. Specifically, the blade 30 slides through the aperture 47B of the sleeve 46A and is held in place by the sleeve 46A. Once the blade 30 is retained within the sleeve 46A, the rotor 34 is placed on the upper races 45 of the insulated rotor-mounting base 40 and secured in place by a rotor bracket 50. The rotor bracket 50 has a flat portion 51 that engages a complementary flat surface area 55 of the rotor 34 upon rotation thereof. The flat portion 51 of the rotor bracket 50 limits rotation of the rotor 34 in one direction. By way of illustration, and not limitation, the rotor bracket 50 prevents the rotor 34 from rotating substantially greater than 45° from the position when the blade 30 engages the jaws 38A and 38B. This way, the blades 30 do not inadvertently come into contact with the door 14 of the enclosure 12 when rotated.

In the illustrated embodiments, the switch assembly 20 is mated with the switching mechanism 22, which is operable to effect actuation of the switch assembly 20 upon movement of the handle 16. As shown in FIG. 1, the switching mechanism 22 is connected to the inner surface of a sidewall of the enclosure 12. The switching mechanism 22 is also connected to the switch assembly 20, namely the rotor 34. For example, the switching mechanism 22 has a complementary hub component that engages a protrusion 39 at the second end 37 of the rotor 34. The handle 16 outside the enclosure 12 engages the switching mechanism 22, for example, through a shaft. In alternative configurations, the movement of the rotor 34 can be automated, for example, by a DC electric motor.

In use, the handle 16 outside the enclosure 12 can be selectively moved between "ON" and "OFF" positions as desired by the user. During movement of the handle from one position to the other, the switching mechanism 22 operates to quickly accumulate kinetic energy from the movement of the handle, store the energy, and rapidly release the energy to rotate the rotor 34. Thus, when the switching mechanism 22 releases the stored kinetic energy, the rotor 34 is quickly rotated, which in turn rotates the blade 30 to rapidly engage and disengage the blade 30 from the jaws 38A and 38B. An exemplary switching mechanism that operates in conjunction with the foregoing description is described in extensive detail in U.S. Pat. No. 5,739,488, to Terry A. Cassity et al., which issued on Apr. 14, 1998 and is entitled "Switch Operating Mechanism Including Handle," and is incorporated herein by reference in its entirety.

As shown in FIG. 2, the switch assembly 20 also includes an arc suppressing housing 42 that removably connects to the insulating base 28. The arc suppressing housing 42 has opposing top and bottom walls 53 and 63 connected by integrally formed opposing lateral sidewalls 57 and 59 that extend therebetween. The top wall 53 has an elongated notch 59 that is configured (i.e., shaped and sized) to allow the blade 30 and at least a portion of the corresponding sleeve 46B of the rotor 34 to freely rotate and pass through the arc suppressing housing 42, as illustrated in FIG. 2. A protrusion 61 extends generally downward from a forward edge of the bottom wall 63 of the arc suppressing housing 42. The protrusion 61 connects to the U-shaped stand 31, thereby operatively aligning the arc suppressing housing 42 with the insulating base 28.

The arc suppressing housing 42 has a plurality of shelves, designated generally as 65 in FIG. 2, between the opposing lateral sidewalls 57, 59. An arc suppressing plate 44 extends through the opening at the end of the housing 42 and is seated on each of the shelves 65. In the illustrated embodiment, there are two separate and distinct sets of arc suppressing plates 44 that surround the jaws 38A and 38B. FIG. 3 shows a first set of arc suppressing plates 44A that is laterally spaced from a second set of arc suppressing plates 44B to form a gap therebetween, which allows the blade 30 to pass between the two sets of arc suppressing plates 44A, 44B and engage the jaws 38A and 38B. In some embodiments, each set of arc suppressing plates 44A, 44B includes 14 arc suppressing plates 44. The arc suppressing assembly (i.e., housing 42 and blades 44) effectively surrounds the blade 30 and jaws 38A and 38B to quench electrical arcs released when the blade 30 engages or disengages the first jaws 38A and 38B and to protect the other components in the switch assembly 20. In other words, the first plurality of arc suppressing plates 44A is configured to extinguish electrical arcs between a first plate 86 of the blade 30 and the first jaw 38A, whereas the second plurality of arc suppressing plates 44B is configured to extinguish electrical arcs between a second plate 88 of the blade 30 and the second jaw 38B.

Figure 4:
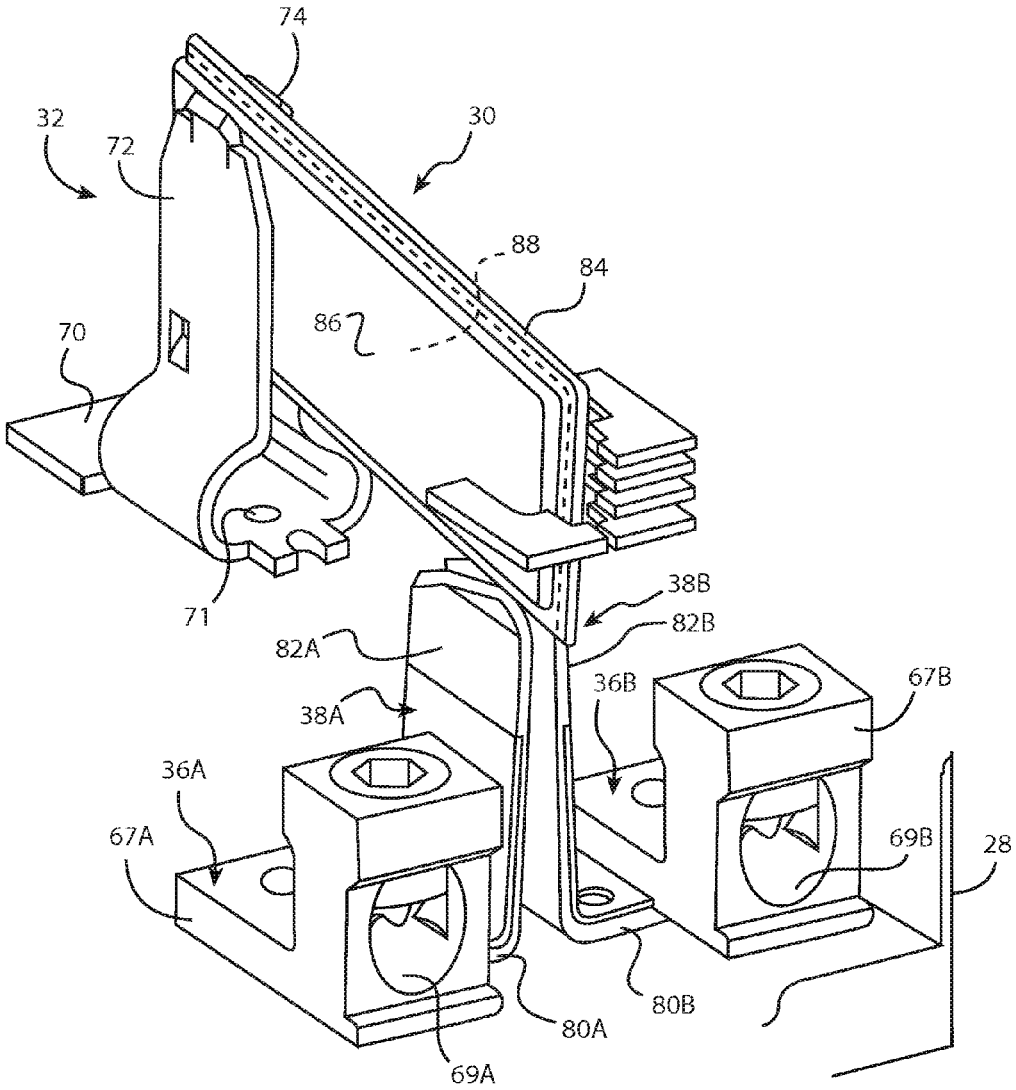
FIG. 4 is an enlarged isometric illustration of the exemplary electrical switch assembly of FIG. 2 showing just the blade, hinge, jaws, and lugs.

With reference now to FIG. 4, the blade hinge 32, the lugs 36A, 36B, and jaws 38A, 38B are generally mounted in spaced relation on the insulating base 28. The first jaw 38A is configured to electrically connect to the incoming line of the electrical circuit, whereas the second jaw 38B is configured to electrically connect to the outgoing line. The first lug connector 36A mechanically couples the first jaw 38A to the platform 28, and the second lug connector 36B mechanically couples the second jaw 38B to the platform 28. As seen in FIG. 4, the first and second lug connectors 36A, 36B are geometrically identical to one another. Each lug connector 36A, 36B has a generally L-shaped body 67A and 67B, respectively, each with a respective opening 69A and 69B for securely receiving an electrical wire.

The blade 30 is pivotably coupled to the platform via an electrically conductive mounting hinge 32. In the illustrated embodiment, the mounting hinge has a single-piece, unitary body comprised of a substantially planar base 70 and laterally opposing, substantially parallel tabs 72 and 74 that extend generally perpendicularly from the base 70. The blade mounting hinge 32 is fabricated from an electrically conductive material. In some embodiments, the hinge 32 is made from a single, integral piece of flat copper sheet metal that is initially formed to the required dimensions and is then bent to the desired shape. The mounting hinge 32 operatively attaches to the insulating base 28. By way of non-limiting example, the base 70 of the blade hinge 32 can be provided with apertures 71 for securing directly to the insulating platform 28 with threaded fasteners. The blade 30 is received between the opposing tabs 72, 74. The blade 30 can be pivotably attached to the hinge 32 via a lateral hinge pin 90 (shown in FIG. 5). In some embodiments, a biasing member operatively engages the blade 30, biasing the blade 30 toward a disengaged position.

In the illustrated embodiment, the blade 30 is a tripartite construction comprised of an electrical insulator 84 and at least two electrical conductors: one electrical conductor is represented herein by a first electrically conductive plate 86, whereas the other electrical conductor is represented herein by a second electrically conductive plate (shown hidden in FIG. 4 at 88). In some embodiments, each electrically conductive plate 86, 88 is fabricated from a generally rectangular metal plate, such as copper or aluminum, that is coated with a corrosion resistant plating. The first electrically conductive plate 86 is attached to and spaced from the second electrically conductive plate 88 via the electrical insulator 84.

As seen in FIG. 4, the first electrically conductive jaw 38A is distinct and separate from the second electrically conductive jaw 38B. Each of the jaws 38A, 38*b* has a substantially planar bottom portion 80A and 80B, respectively, with an integral elongated tab portion 82A and 82B extending upwardly therefrom. The first and second electrically conductive jaws 38A, 38B are oriented in opposing spaced relation to one another such that complementary flat outer surfaces of the elongated tab portions 82A, 82B are facing one another. The elongated tab portions 82A, 82B cooperate to create upstanding cantilever spring legs and form a pair of spring jaws for receiving the blade 30 between the first and second electrically conductive jaws 38A, 38B to electrically engage and disengage the blade 30 in response to pivoting movement of the blade 30.

The blade 30 is pivotably coupled to the platform 28 (e.g., via hinge 32) to rotate between a disengaged position (seen in FIGS. 2 and 3), whereat the blade 30 is spaced from and electrically decoupled from the first and second jaws, and an engaged position (seen generally in FIG. 5), whereat the blade 30 is located at least partially between the first and second jaws 38A, 38B such that the blade 30 delivers an electrical current received from the first jaw 38A through the first plate 86, then passes it to the hinge 32 and through the second plate 88, and out through the second jaw 38B. When the blade is in the engaged position, the first plate contacts the first jaw and not the second jaw, and the second plate contacts the second jaw and not the first jaw. Moving the blade from the engaged position to the disengaged position breaks down the voltage of the electrical current separately at the first jaw 38A and at the second jaw 38B. This allows for each arc to be managed separately, as described above, which allows the switch assembly 20 to have a higher voltage per pole. In other words, by dividing the arc voltage in half, it can be managed more efficiently and allow each pole of the switch to be used separately as opposed to using two poles in series.

Depending on whether a fusible or a non-fusible switching assembly is to be employed, a variety of additional components are added to the above described switch assembly 20. In a non-fusible switching assembly, a load terminal is utilized. The load terminal directly contacts and is secured to the bottom of the blade hinge 32. Otherwise, no additional connecting members are typically required. In a fusible switching assembly, additional electrical contacts, an additional insulating base, a fusible member, and a load terminal are required. A more detailed discussion of how various components work to provide a fusible or a non-fusible switching assembly is provided in U.S. Pat. No. 6,331,684, to Hamid S. Abroy et al., which issued on Dec. 18, 2001 and is entitled "Modular Switch Assembly," incorporated herein by reference above.

Figure 5:
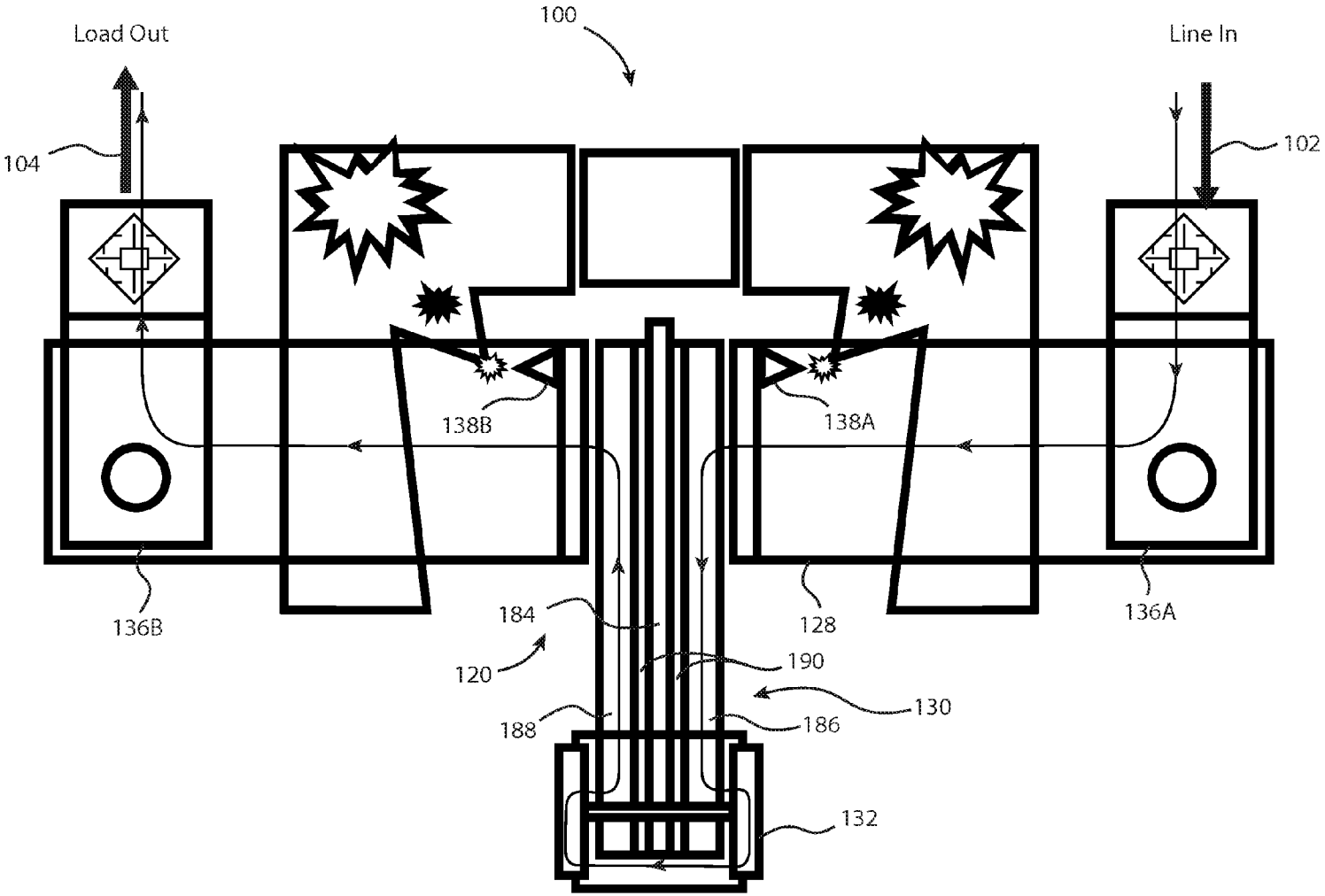
FIG. 5 is a schematic illustration of an exemplary electrical circuit with a dual breaking electrical joint in accordance with embodiments of the present disclosure.

FIG. 5 is a schematic illustration of an exemplary electrical circuit 100 with a dual breaking electrical joint 120 in accordance with embodiments of the present disclosure. In general, the breaking electrical joint 120 is adapted for making and breaking electrical connections in an electrical circuit having an incoming line 102 and an outgoing line 104. A first electrically conductive jaw 138A is operatively attached to an electrically insulated platform 128. The first jaw 138A is electrically connected to the incoming line 102 of the electrical circuit 100. A second electrically conductive jaw 138B is operatively attached to the electrically insulated platform 128 spaced from but adjacent to the first jaw 138A. The second jaw 138B is electrically connected to the outgoing line 104 of the electrical circuit 100. As seen in the drawings, the first jaw 138A is distinct and separate from the second jaw 138B. A first lug connector 136A couples the first jaw 138A to the platform 128 and the incoming electrical line 102. A second lug connector 136B couples the second jaw 138B to the platform 128 and the outgoing electrical line 104.

The dual breaking electrical joint 120 also includes a multilayer blade 130. In the illustrated embodiment, the blade 130 is a tripartite construction, although more than three layers is certainly envisioned. The blade 130 includes an electrical insulator 184 that extends between and spans the entire area of first and second electrically conductive plates 186 and 188, respectively. The first electrically conductive plates 186 is attached to and spaced from the second electrically conductive plate 188 via the electrical insulator 184. In this embodiment, the plates 186, 188 are attached to the electrical insulator 184 via layers of adhesive 190.

The blade 130 is pivotably coupled to the platform 128 via an electrically conductive mounting hinge 132. The mounting hinge 132 of FIG. 5 is a single-piece construction fabricated at least partially from an electrically conductive material. The mounting hinge 132 electrically connect the first electrically conductive plate 186 to the second electrically conductive plate 188. The blade 130 selectively pivots between a disengaged position (see, e.g., FIGS. 2 and 3), whereat the blade 130 is electrically decoupled from the first and second jaws 138A, 138B, and an engaged position (as seen in FIG. 5), whereat the blade 130 delivers an electrical load received from the first jaw 138A through the first and second plates 186, 188 to the second jaw 138B. The blade 130 is located at least partially between the first and second jaws 138A, 138B when in the engaged position, but is distal from the first and second jaws 138A, 138B when in the disengaged position. When in the engaged position, the first plate 186 contacts the first jaw 138A and not the second jaw 138B, and the second plate 188 contacts the second jaw 138B and not the first jaw 138A. Moving the blade 130 from the engaged position (FIG. 5) to the disengaged position (FIG. 2) breaks down the voltage of the electrical load separately at the first jaw 138A and at the second jaw 138B.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims. To that extent, elements and limitations that are disclosed, for example, in the Abstract, Summary, and Detailed Description sections, but not explicitly set forth in the claims, should not be incorporated into the claims, singly or collectively, by implication, inference or otherwise

What is claimed is:

1. A switch assembly for making and breaking electrical connections in an electrical circuit having an incoming line and an outgoing line, the switch assembly comprising:

a platform;

a first electrically conductive jaw operatively attached to the platform, the first jaw being configured to electrically connect to the incoming line of the electrical circuit;

a second electrically conductive jaw operatively attached to the platform adjacent the first jaw, the second jaw being configured to electrically connect to the outgoing line;

a blade comprising an electrical insulator and a first electrically conductive plate attached to and spaced from a second electrically conductive plate via the electrical insulator; and an electrically conductive element electrically connecting the first and second electrically conductive plates, wherein the blade is pivotably coupled to the platform to rotate between a disengaged position, whereat the blade is electrically decoupled from the first and second jaws, and an engaged position, whereat the blade delivers an electrical current received from the first jaw through the first and second plates and the electrically conductive element to the second jaw.

2. The switch assembly of claim 1, wherein moving the blade from the engaged position to the disengaged position breaks down the voltage of the electrical current separately at the first jaw and at the second jaw.

3. The switch assembly of claim 1, wherein the first jaw is distinct and separate from the second jaw.

4. The switch assembly of claim 1, wherein the first jaw includes a first elongated tab attached to and extending upwardly from the platform, and the second jaw includes a second elongated tab attached to and extending upwardly from the platform, the second elongated tab being distinct and separate from the first elongated tab.

5. The switch assembly of claim 1, wherein the electrically conductive element is an electrically conductive mounting hinge, the blade being pivotably coupled to the platform via the electrically conductive mounting hinge.

6. The switch assembly of claim 5, wherein the mounting hinge includes a single-piece, unitary body.

7. The switch assembly of claim 6, wherein the mounting hinge body has a base, a first tab extending upwardly from the base and contacting the first electrically conductive plate, and a second tab extending upwardly from the base and contacting the second electrically conductive plate.

8. The switch assembly of claim 1, further comprising a first lug connector coupling the first jaw to the platform, and a second lug connector coupling the second jaw to the platform.

9. The switch assembly of claim 1, wherein, when the blade is in the engaged position, the first plate contacts the first jaw and not the second jaw, and the second plate contacts the second jaw and not the first jaw.

10. The switch assembly of claim 1, further comprising a first and a second plurality of arc suppressing plates, the first plurality of arc suppressing plates being configured to extinguish electrical arcs between the first plate and the first jaw, and the second plurality of arc suppressing plates being configured to extinguish electrical arcs between the second plate and the second jaw.

11. The switch assembly of claim 10, further comprising an arc suppressing housing configured to operatively attach the first and second pluralities of arc suppressing plates to the platform.

12. The switch assembly of claim 1, further comprising a biasing member operatively engaged with the blade, the biasing member being configured to bias the blade toward the disengaged position.

13. The switch assembly of claim 1, further comprising a rotor with at least one blade slot, the blade slot receiving the blade therethrough, the rotor being configured to move the blade between the engaged and disengaged positions.

14. The switch assembly of claim 13, further comprising a handle operatively attached to at least one end of the rotor, the handle being configured to rotate the rotor such that the blade is moved between the engaged position and the disengaged position.

15. The switch assembly of claim 5, wherein the electrically conductive mounting hinge includes a hinge pin extending through the blade.

16. A switch assembly for making and breaking electrical connections in an electrical circuit having an incoming line and an outgoing line, the switch assembly comprising:

an electrically insulated platform;

a first electrically conductive jaw mounted to the platform, the first jaw being configured to electrically connect to the incoming line of the electrical circuit;

a second electrically conductive jaw mounted to the platform adjacent the first jaw, the second jaw being configured to electrically connect to the outgoing line; and a blade comprising an electrical insulator and a first electrically conductive plate attached to and electrically insulated from a second electrically conductive plate via the electrical insulator; and an electrically conductive element electrically connecting the first and second electrically conductive plates, wherein the blade is pivotably coupled to the platform to rotate between an engaged position, whereat the blade delivers an electrical current received from the incoming line via the first jaw through the first and second plates and the electrically conductive element to the outgoing line via the second jaw, and a disengaged position, whereat the blade is electrically decoupled from the first and second jaws such that the voltage of the electrical load is broken down separately at the first jaw and at the second jaw.

17. An electrical distribution device for connecting to an electrical circuit with an incoming line and an outgoing line, the electrical distribution device comprising:

an enclosure;

an electrically insulated platform disposed within the enclosure;

a first electrically conductive jaw mounted to the platform, the first jaw being configured to electrically connect to the incoming line of the electrical circuit;

a second electrically conductive jaw mounted to the platform adjacent the first jaw, the second jaw being configured to electrically connect to the outgoing line, the second jaw being distinct and spaced from the first jaw;

a blade comprising an electrical insulator and a first electrically conductive plate attached to and electrically insulated from a second electrically conductive plate via the electrical insulator, an electrically conductive single-piece mounting hinge pivotably coupling the blade to the platform, the electrically conductive mounting hinge electrically connecting the first electrically conductive plate to the second electrically conductive plate; and a rotor rotatably mounted within the enclosure, the rotor having at least one blade slot receiving the blade therethrough, the rotor being configured to selectively move the blade between a disengaged position, whereat the blade is electrically decoupled from the first and second jaws, and an engaged position, whereat the blade distributes an electrical current received from the incoming line via the first jaw through the first and second plates and the electrically conductive mounting hinge to the outgoing line via the second jaw.

18. The switch assembly of claim 16, wherein the electrically conductive element is an electrically conductive mounting hinge, the blade being pivotably coupled to the platform via the electrically conductive mounting hinge.

19. The switch assembly of claim 18, wherein the electrically conductive mounting hinge includes a hinge pin extending through the blade.

* * * * *